US005490577A

United States Patent [19]

Yoo

[11] Patent Number: 5,490,577

[45] Date of Patent: Feb. 13, 1996

[54] FLEXIBLE ELEVATOR HITCH

[75] Inventor: Young S. Yoo, Avon, Conn.

[73] Assignee: Otis Elevator Company, Farmington, Conn.

[21] Appl. No.: 263,864

[22] Filed: Jun. 22, 1994

[51] Int. Cl.[6] ..... B66B 11/08

[52] U.S. Cl. ..... 187/252; 187/254; 187/265; 187/266; 187/401

[58] Field of Search ..... 187/401, 251, 187/252, 254, 264, 265, 266

[56] References Cited

U.S. PATENT DOCUMENTS

| | | | |
|---|---|---|---|
| 808,042 | 12/1905 | Gould | 187/401 X |
| 1,164,115 | 12/1915 | Pearson | 187/254 |
| 1,424,438 | 8/1922 | Baum | 187/252 X |
| 1,682,078 | 8/1928 | Hanlen | 187/401 |
| 1,905,273 | 4/1933 | Dunlop | 187/264 |
| 1,907,967 | 5/1933 | Himes | 187/401 |
| 4,660,682 | 4/1987 | Luinstra et al. | 187/401 |

FOREIGN PATENT DOCUMENTS

| | | | |
|---|---|---|---|
| 213589 | 1/1990 | Japan | 187/251 X |
| 3256986 | 11/1991 | Japan | 187/251 X |
| 4144891 | 5/1992 | Japan . | |
| 260852 | 1/1970 | U.S.S.R. | 187/266 X |
| 729043 | 5/1955 | United Kingdom | 187/251 X |
| 1442584 | 7/1976 | United Kingdom | 187/265 X |

*Primary Examiner*—William E. Terrell
*Assistant Examiner*—Dean A. Reichard

[57] ABSTRACT

An elevator having a car suspended by a rope in a 2:1 roping arrangement has a sheave for receiving the ropes and a structure for rotatably supporting the sheave. A flexible member is used to attach the structure to a car, which minimizes the transference of moments from the structure to the car. In addition, a damping material is used in mounting the flexible member to the car and support structure which reduces vibration and noise transmissions. Springs are also placed at the top and bottom of the flexible member to isolate low frequency vibrations in the vertical direction.

7 Claims, 3 Drawing Sheets

FLEXIBLE ELEVATOR HITCH

BACKGROUND OF THE INVENTION

1. Field of the Invention

The invention relates in general to a flexible elevator hitch and more specifically to an apparatus for minimizing the moments and vibrations transmitted to an elevator car.

2. Description of the Related Arts

Generally, an elevator car is supported by several wire ropes that attach at a first end to a car, passes over a drive sheave, and attach at the other end to a counterweight. In 2:1 roping arrangements, however, the wire ropes terminate at a dead hitch plate at the top of the hoistway and each rope attach to the car or counterweight by means of a sheave rotatably mounted thereon.

:Elevators employing 2:1 roping arrangements having a car sheave mounted to the top of a car experience a torque and vibrations associated with horizontal and vertical rope movements. These moments and vibrations are transmitted to the car, often amplified in magnitude, via a rigid member used to connect the sheave support structure to the car. In addition, torque vibrations created by the drive mechanism produce noise which is also transmitted to the car through the rigid member. Unfortunately, both the vibrations and the noise are extremely difficult to isolate when using only a rigid member to connect the support structure to the car, and attempting to minimize these problems can be expensive.

SUMMARY

It is an object of this invention to minimize the moments transmitted through the sheave support structure.

It is a further object of this invention to reduce the vibrations transmitted through the sheave support structure.

It is a further object of this invention to reduce car noise.

According to the invention, an elevator having a car suspended by a rope comprises a sheave for receiving the ropes, a structure for rotatably supporting the sheave, and a flexible member for attaching the structure to the car which minimizes the transference of moments from the structure to the car.

According further to the invention, the means which mounts the flexible member to the support structure includes a damping material which reduces vibration and noise transmissions from the sheave support structure to the car.

According to a feature of the invention, hitch springs are placed at the top and bottom of the flexible member thereby isolating low frequency vibrations in the vertical direction.

According to another embodiment of the invention, an attachment for suspending a body from a rope, where the attachment attaches a support rotatably holding a sheave to the body, comprises: a first end portion attaching to the support, a second end portion attaching to the body, and a flexible member connecting the first end to the second end, where the member flexes to minimize the transference of moments from the structure to the body.

These and other features and advantages of the present invention will be apparent from the specification and claims and from the accompanying drawings which illustrate an embodiment of the invention.

BEST MODE FOR CARRYING OUT THE INVENTION

Figure 1:
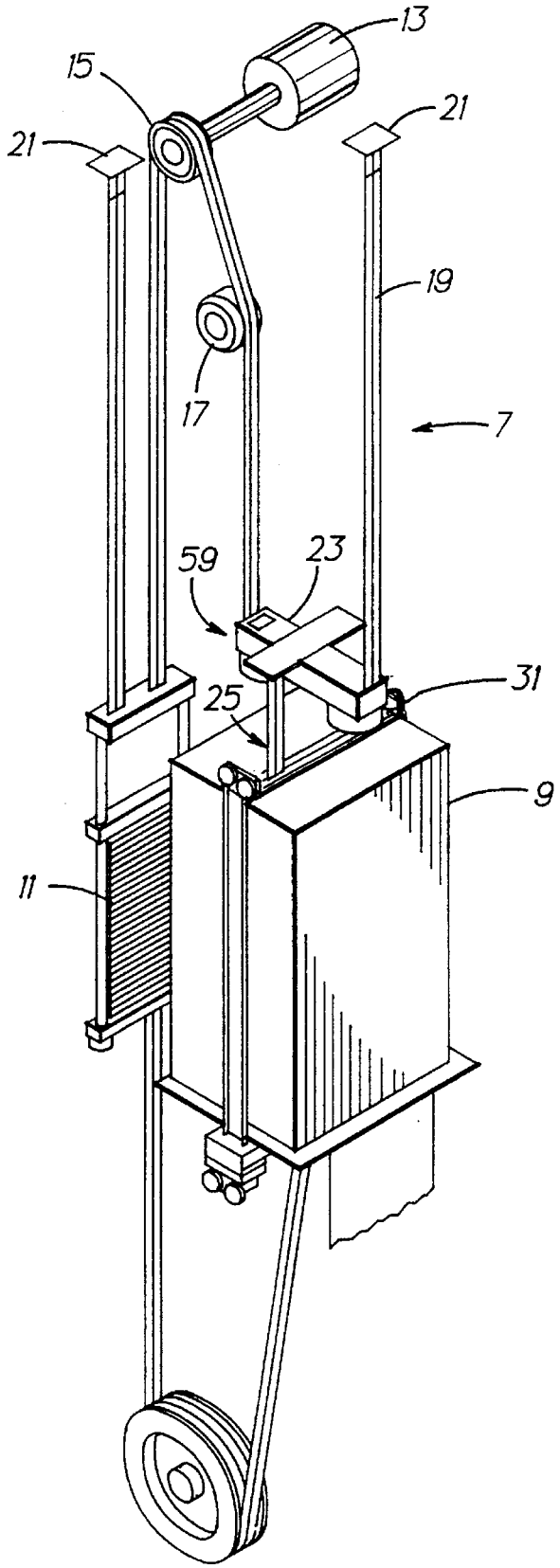
FIG. 1 shows a perspective view of an elevator with 2:1 roping.

Referring to FIG. 1, an elevator 7 includes two major movable components, an elevator car 9 and a counterweight 11, which are mounted in the hoistway of a building for guided vertical movement between predetermined travel limits. A drive means 13 is disposed to drive the elevator car and its counterweight via a sheave and rope arrangement which includes a traction or drive sheave 15, a secondary sheave 17, and a plurality of wire ropes shown generally at 19, as is known in the art. In 2:1 roping arrangements like that shown in FIG. 1, the ropes terminate at a dead hitch plate 21 in the overhead above the hoistway and the ropes attach to the car or counterweight by means of sheave support structure 23. The sheave support structure is of the type conventionally used in 2:1 roping arrangements having a rigid member, and is adapted for use with the present invention.

Figure 2:
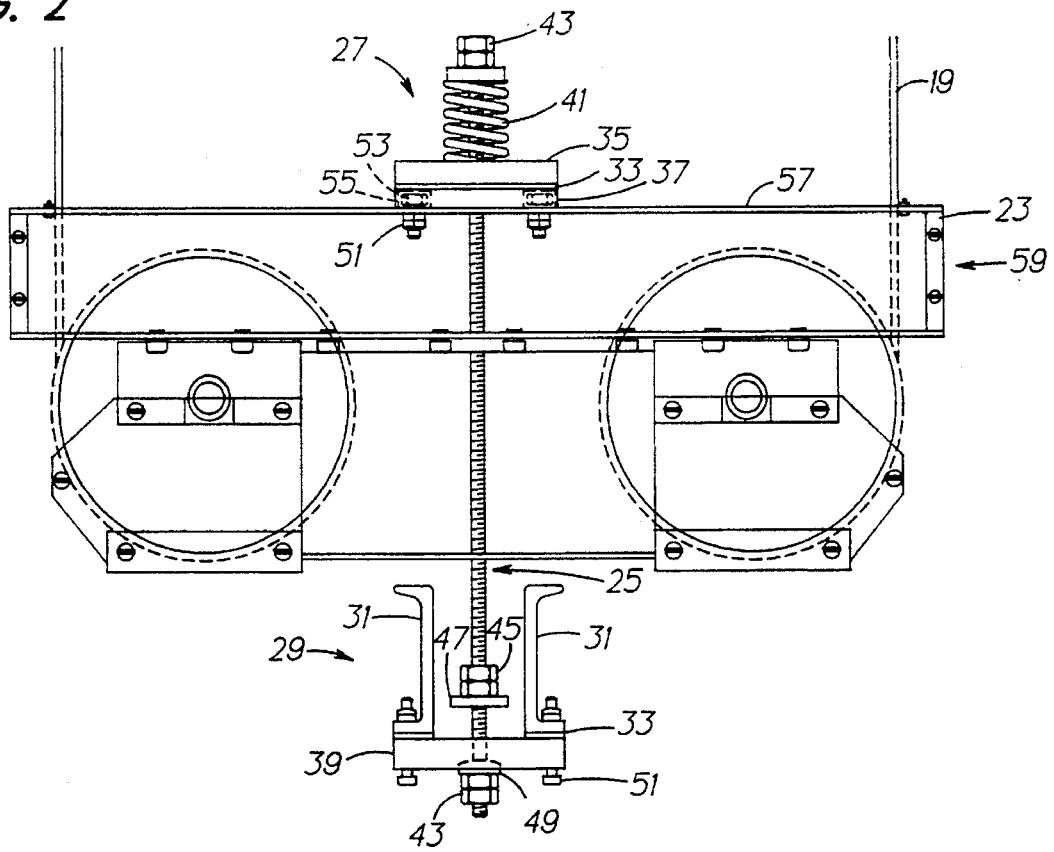
FIG. 2 shows a side plan view of an embodiment of the present invention as shown in FIG. 1.

An embodiment of the present invention is described with reference to FIGS. 1–4. As shown in FIG. 1 and 2, an apparatus for suspending an elevator car 9 from the sheave support structure 23 comprises: a plurality of flexible members 25, and an upper mounting assembly 27 and lower mounting assembly 29 attaching the flexible members to the sheave support structure and to the crosshead 31.

Figure 4:
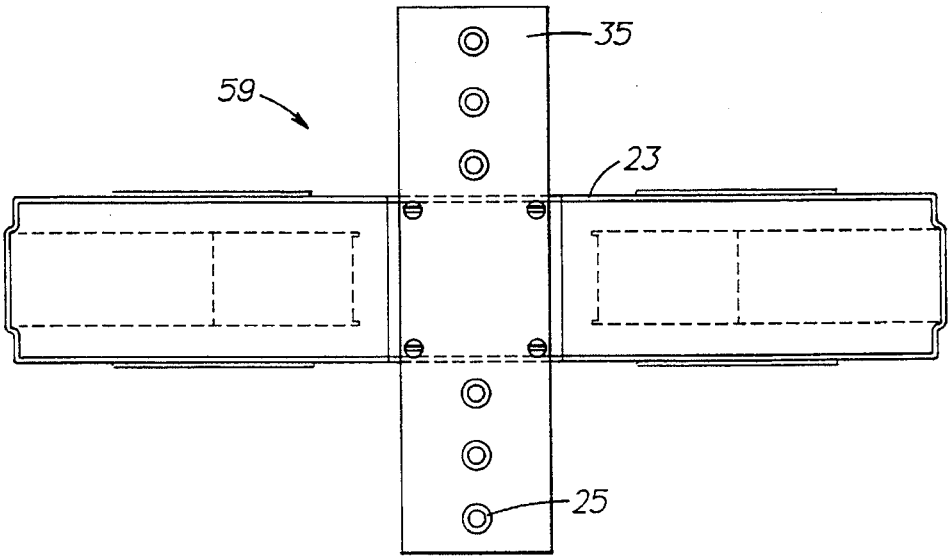
FIG. 4 shows a top plan view of an embodiment of the present invention as shown in FIG. 2.
Figure 3:
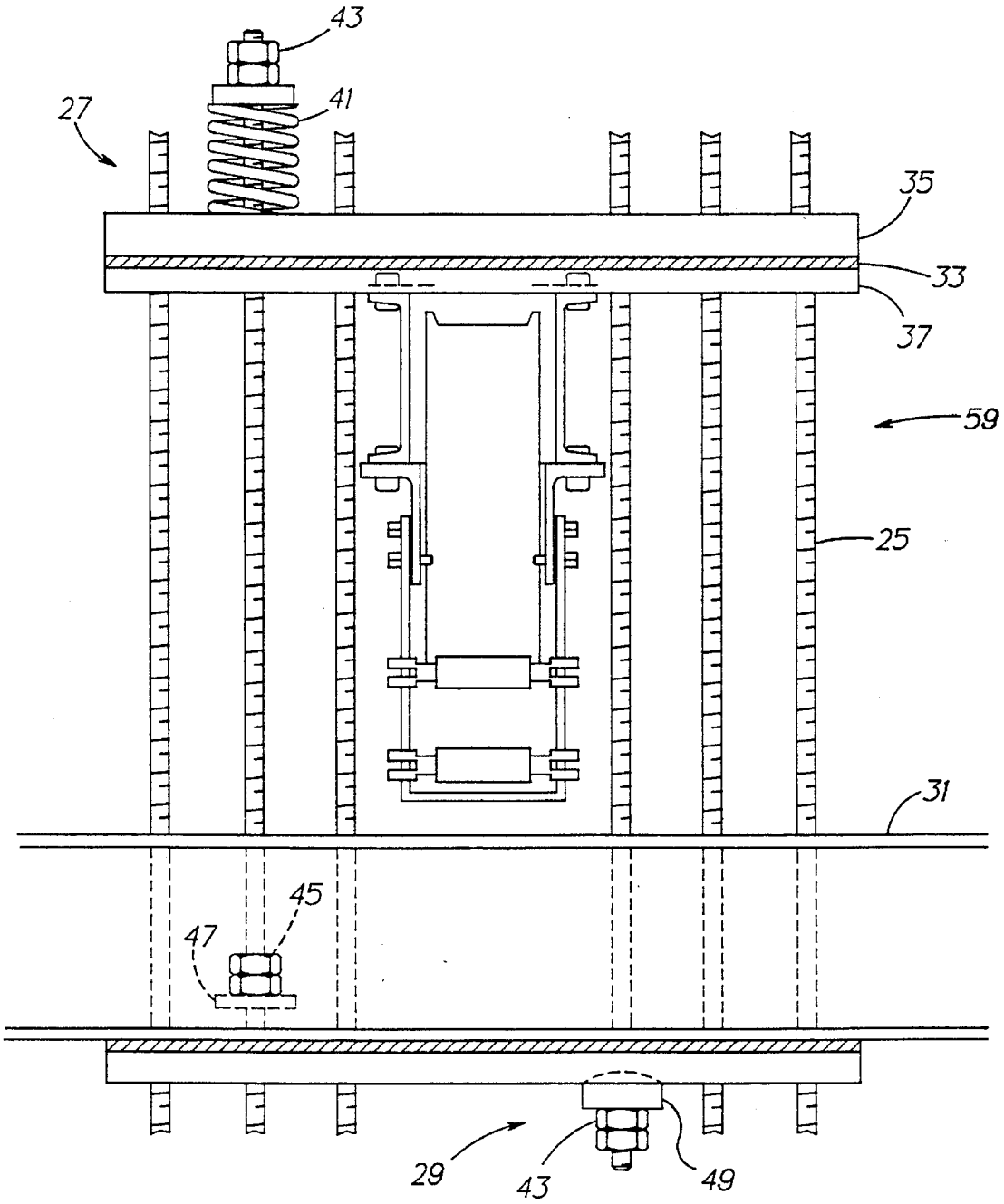
FIG. 3 shows a front plan view of an embodiment of the present invention as shown in FIG. 2.

Referring to FIGS. 2–4, the sheave support structure 23 is connected to the crosshead 31 using six flexible members 25. The flexible members are long threaded rods made of hardened steel or other material having the appropriate strength and flexibility. The diameter of the flexible member varies depending on the load which it is to sustain but normally ranges from one-half inch to one inch. In addition, the flexible member must be sufficiently flexible, as one of ordinary skill in the art would readily appreciate given the teachings of this invention, to absorb the moments introduced on the sheave support structure. The flexibility of these members derives from their long, thin shape and differs from previous designs which use only a single rigid member having a much larger diameter.

Referring to FIGS. 2 and 3, a means for mounting the flexible member 25 comprises: an isolation material 33, a top hitch plate 35, a bottom isolation plate 37, a bottom hitch plate 39, a spring 41, a first lock nut 43, a second lock nut 45, a protection nut 47, a spherical washer 49, and mounting bolts 51. At the upper mounting assembly 7, the top hitch plate 35 and the bottom isolation plate 37 serve as surfaces to hold the isolation material 33. The bottom isolation plate is fastened to the top 57 of the sheave support structure 23 using mounting bolts 51, however the bolts do not traverse through the isolation material or the top hitch plate. The bolt head 53 is disposed in recess 55, thus preventing contact between the bolt and the isolation material. A spring 41 which fits over the flexible member 25 is seated against the top hitch plate and is held in place using a pair of first lock nuts 43 threaded to the top of the flexible member. Each spring will normally be required to withstand 500–1000 pounds per inch, however they must collectively bear the weight of the car and therefore this amount could vary depending on the load weight and number of springs used.

At the lower mounting assembly 29, the bottom hitch plate 39 and crosshead 31 serve as the surfaces for holding the isolation material 33 and are connected together using mounting bolts 51. The isolation material is made of Fabcel® which is manufactured by Fabreeka International, Inc. of Soughton, Mass., and has grooves in two directions, however any other material having the appropriate isolation characteristics which serve to absorb vibrations and reduce noise may be used. In addition, a protection nut 47 anchored in position by a pair of second lock nuts 45 is threaded to the flexible member 25 and is situated just above the bottom hitch plate 39 to block any upward vertical movements which may occur. The flexible member is fixed to the bottom hitch plate with a spherical washer 49 held in place with a pair of first lock nuts 43, thus allowing the flexible member some freedom to rotate.

Referring to FIGS. 2–4 the advantages of the present system can be seen. One advantage of the present invention derives from its ability to be customized to particular embodiments in an inexpensive manner. For instance, the use of multiple flexible members allow springs to be attached in any combination to the ends of the flexible members in order to isolate low frequency vibrations in the vertical direction. The actual number of flexible members used to minimize the moments can also be varied depending on tile expected load weight of a given embodiment. In addition, since threaded flexible members are commercially available, their size and length can be easily customized for a particular system and the threads allow for an inexpensive way to fasten the rods at any point using standard lock nuts.

Other advantages also accrue by using multiple flexible members in connecting the sheaves support structure to the car since this arrangement allows for isolation material to be used in mounting the flexible members. Prior designs using only a single rigid connector made it extremely difficult and expensive to isolate the noise and vibrations transmitted through the sheave support structure since there was no place to apply an isolation material. However, the present design provides for a relatively simple and inexpensive way to minimize these problems. The isolation material can be made of Fabcel®, which has advantages over other materials since its bi-directional groves allows more flexibility in absorbing vibrations than other material such as flat rubber.

Although the invention has been shown and described with respect to a best mode embodiment thereof, this invention works with any suspended body roped 2:1 and it should be understood by those of ordinary skill in the art, that various omission, changes and additions in the form and detail thereof may be made without departing from the spirit and scope of the invention.

I claim:

1. A flexible elevator hitch having a car suspended by ropes, said elevator hitch comprising:

a sheave for receiving said ropes, a structure for rotatably supporting said sheave, and a flexible member for attaching said structure to said car, said flexible member minimizing transference of moments from said structure to said car.

2. The flexeble elevator hitch of claim 1 further comprising:

means for attaching said flexible member to said structure and said car, and for isolating said flexible member from said structure and said car, said means for isolating minimizing transference of noise and vibration from said structure to said car.

3. The flexible elevator hitch of claim 2 wherein said means for attaching comprises:

a damping material.

4. The flexible elevator hitch of claim 2 wherein said means for attaching comprises:

a spring.

5. An attachment for suspending a body from a rope, said attachment attaching to said body a structure rotatably holding a sheave through which said rope passes, said attachment comprising:

a first end portion attaching to said structure, a second end portion attaching to said body, and a flexible member connecting said first end portion to said second end portion, said flexible member flexing to minimize transference of moments from said structure to said body.

6. The flexible elevator hitch of claim 1, further comprising:

a plurality of said flexible member for attaching said structure to said car.

7. The attachment of claim 5, further comprising:

a plurality of said flexible member connecting said first end portion to said second end portion.

* * * * *